United States Patent [19]

Leupold et al.

[11] Patent Number: 5,034,715

[45] Date of Patent: Jul. 23, 1991

[54] PERMANENT MAGNET FIELD SOURCES OF CONICAL ORIENTATION

[75] Inventors: Herbert A. Leupold, Eatontown; Ernest Potenziani, II, Ocean, both of N.J.

[73] Assignee: The United States of America as represented by the Secretary of the Army, Washington, D.C.

[21] Appl. No.: 436,402

[22] Filed: Nov. 14, 1989

[51] Int. Cl.[5] ..... H01F 7/00

[52] U.S. Cl. ..... 335/306; 335/304; 335/301; 335/210

[58] Field of Search ..... 335/306, 304, 301, 210

[56] References Cited

U.S. PATENT DOCUMENTS 3,205,415 9/1965 Seki et al. ..... 335/210

3,768,054 10/1973 Neugebauer ..... 335/304

*Primary Examiner*—Gerald P. Tolin

*Assistant Examiner*—Trinidad Korka

*Attorney, Agent, or Firm*—Michael Zelenka

[57] ABSTRACT

A magnetic structure fabricated of magnetically rigid materials combines a radial magnetic field source with an axial magnetic field source to produce a conical field source. The radial magnetic field source typically comprises a substantially annular enclosed cavity with an internal magnetic field oriented perpendicular to the annular axis of the cavity. The axial magnetic field source most likely comprises a substantially cylindrical enclosed cavity with an internal magnetic field oriented parallel to the cylindrical axis of the cavity.

8 Claims, 3 Drawing Sheets

PERMANENT MAGNET FIELD SOURCES OF CONICAL ORIENTATION

The invention described herein may be manufactured, used, and licensed by or for the Government for governmental purposes without payment to us or any royalties thereon.

TECHNICAL FIELD

The present invention relates generally to permanent magnet structures wherein magnetically rigid (hereinafter MR) materials are utilized to derive high magnetic fields of uniform flux density, and more particularly to magnetic fields of conical orientation.

BACKGROUND OF THE INVENTION

Many devices that employ magnetic fields have heretofore been encumbered by massive solenoids with their equally bulky power supplies. Thus, there has been increasing interest in the application of permanent-magnet structures for such uses as electron-beam focusing and biasing fields. The current demand for compact, strong, static magnetic field sources that require no electric power supplies has created needs for permanent magnet structures of unusual form. A number of configurations have been designed and developed for electron-beam guidance in mm/microwave tubes of various types; for dc biasing fields in millimeter wave filters, circulators, isolators, strip-lines; for field sources in NMR (nuclear magnetic resonance) imagers; and so on.

Various prior art structures have contributed to the development of technology in this area. For example, U.S. Pat. No. 3,768,054 to Neugebauer, entitled "Low Flux Leakage Magnetic Construction", teaches a number of magnetic circuits utilizing magnetic cladding means to reduce exterior flux leakage an increase the controlled magnetic field intensity. The advantageous features of this and similar devices are, significantly, the reduction of flux loss and very effective control without any increase, in fact most times a decrease, in the size or weigh&. of the magnetic circuit elements.

In many of the prior art structures magnetic fields emanate from the structure parallel to its axis. These structures have provided remarkable results such as significant reduction of flux loss and effective control and increase of the magnetic field intensity. There has been little work done in providing structures with controlled magnetic fields other than those parallel to the axis of the structure.

SUMMARY OF THE INVENTION

A primary object of the invention is to provide a flux source of MR material with which a uniformly high magnetic field within the central cavity is obtained.

It is a related object of the invention to provide a source of flux that has a magnet field of angled or "conical" orientation.

A further object of the invention is to accomplish the above-stated objects with a combination of at least two flux sources.

These and other objects are accomplished in accordance with the present invention wherein a structure fabricated of MR material combines a radial magnetic field source with an axial magnetic field source to produce a conical field source. The radial magnetic field source typically comprises a substantially annular or cylindrical enclosed cavity with an internal magnetic field oriented perpendicular to the annular axis of the cavity. The axial magnetic field source most likely comprises a substantially cylindrical enclosed cavity with an internal magnetic field oriented parallel to the cylindrical axis of the cavity.

DESCRIPTION OF THE DRAWINGS

The invention will be more fully appreciated from the following detailed description when the same is considered in connection with the accompanying drawings in which.

DETAILED DESCRIPTION OF THE DRAWINGS

Figure 1:
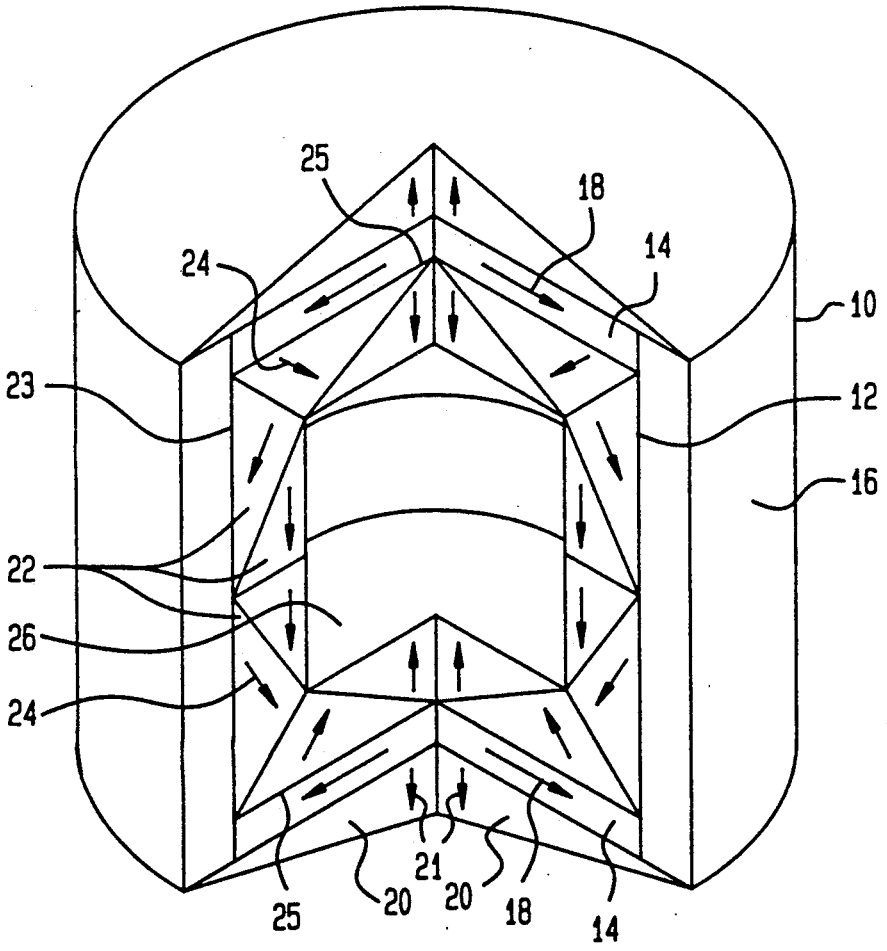
FIGS. 1, 2 and 3 are cross-sectional schematic diagrams of flux source structures, one embedded or nested inside the other, illustrating the magnetizations in the segments of the structures.

FIG. 1 shows an embodiment of the present invention which comprises two hollow flux sources 10 and 12, with the latter nested within the former such that the exterior of the inner structure abuts the interior of the outer structure. The outer structure 10 is the radial magnetic field source. The radial magnetic field of the outer structure is generated by magnetic discs 14, coaxially aligned parallel to and separated from each other by a given distance. An iron ring 16 circumscribes and contacts the discs. Arrows 18 illustrate the magnetic orientation of the discs whereby a resultant radial field directed inward is created. The iron ring serves to assure a magnetic equipotential surface across the entire outer cylindrical periphery of the cavity. Cladding magnets 20 are disposed exterior to the planar face of each disc and extend out over the iron ring. The magnetic orientation 21 is in a direction perpendicular to and away from the plane of the magnetic discs 14, reducing exterior flux leakage and increasing controlled magnetic field intensity.

The inner axial field structure 12 comprises a plurality of magnetized segments 22 being substantially circular and having a substantially triangular cross-section. The segments 22 are arranged to construct the hollow cylinder 23 and closures 25 on both ends thereof, forming a cylindrical enclosed cavity 26 therein. A full description of this cylindrical structure ca be found in "Enhanced Magnetic Field Within Enclosed Cylindrical Cavity", to Herbert A. Leupold et al, a co-inventor herein., which is concurrently being filed herewith and is incorporated herein by reference. Each magnetic segment 22, possesses a specific magnetic orientation denoted by arrows 24, to provide a resultant magnetic field in the axial direction. The magnetic segments 22, as well as the magnetic discs 14 of flux source 10 are fabricated of MR materials. These materials are well known to those skilled in the magnetic arts. Some ferrites and rare-earth alloys have been utilized or are being contemplated for use as MR materials, such as Samarium Cobalts and Neodymium-Iron-Boron Alloys. The most pronounced characteristic of MR materials is their very high coercivity (field magnitude required to demagnetize) relative to that of traditional magnetic materials. This characteristic affords the fabrication of structures that exhibit various magnetic circuit effects such as field transparency and flux confinement that are not attainable with traditional materials. As to the former, external magnetic fields up to some magnitude greater than the remanence of MR material can pass therethrough without affecting the magnetic orientation thereof. A resultant field therefore occurs as the vector sum of the external field and the field sustained by the MR material. As to the latter, the magnitude and direction of the magnetization is constant throughout any individual piece of MR material, so that a field source can be constructed of magnetic segments fabricated therefrom, to configure a magnetic circuit as desired and even to completely confine a whole magnetic circuit by enclosing a magnet field in a cavity.

The axial magnetic field source is initially constructed and the radial magnetic field source is subsequently constructed about the exterior of the inner structure. The outer structure may be attached to the inner structure wholly or piece by piece by methods known to those skilled in the art (e.g. glue, cement, epoxy etc.). The superposition of the axial magnetic field within the radial magnetic field results in an angular or "conical" magnetic field. The direction and magnitude of the conical field is determined from the vector sum of the radial field and the axial field. When the axial field is stronger in magnitude than the radial field the resultant conical field radiates in a direction upward (or downward depending upon the direction of the axial field vector) at an angle less than 45° to the conical field axis. Numerous conical fields of uniform magnitude and direction (at any angle) may be realized by combining radial and axial field sources of different magnitudes. The thickness of the magnetic discs may vary with distance from the center of the discs to produce a radial field increasing in (or decreasing depending on where thickness is increased) magnitude with distance from the center of discs. The cladding magnets must be modified in dimensions when the disc thickness is varied to account for the change in flux losses. One example of the resultant conical field will be one that decreases in angle with distance from the central axis and forms parabolic field.

Figure 2:
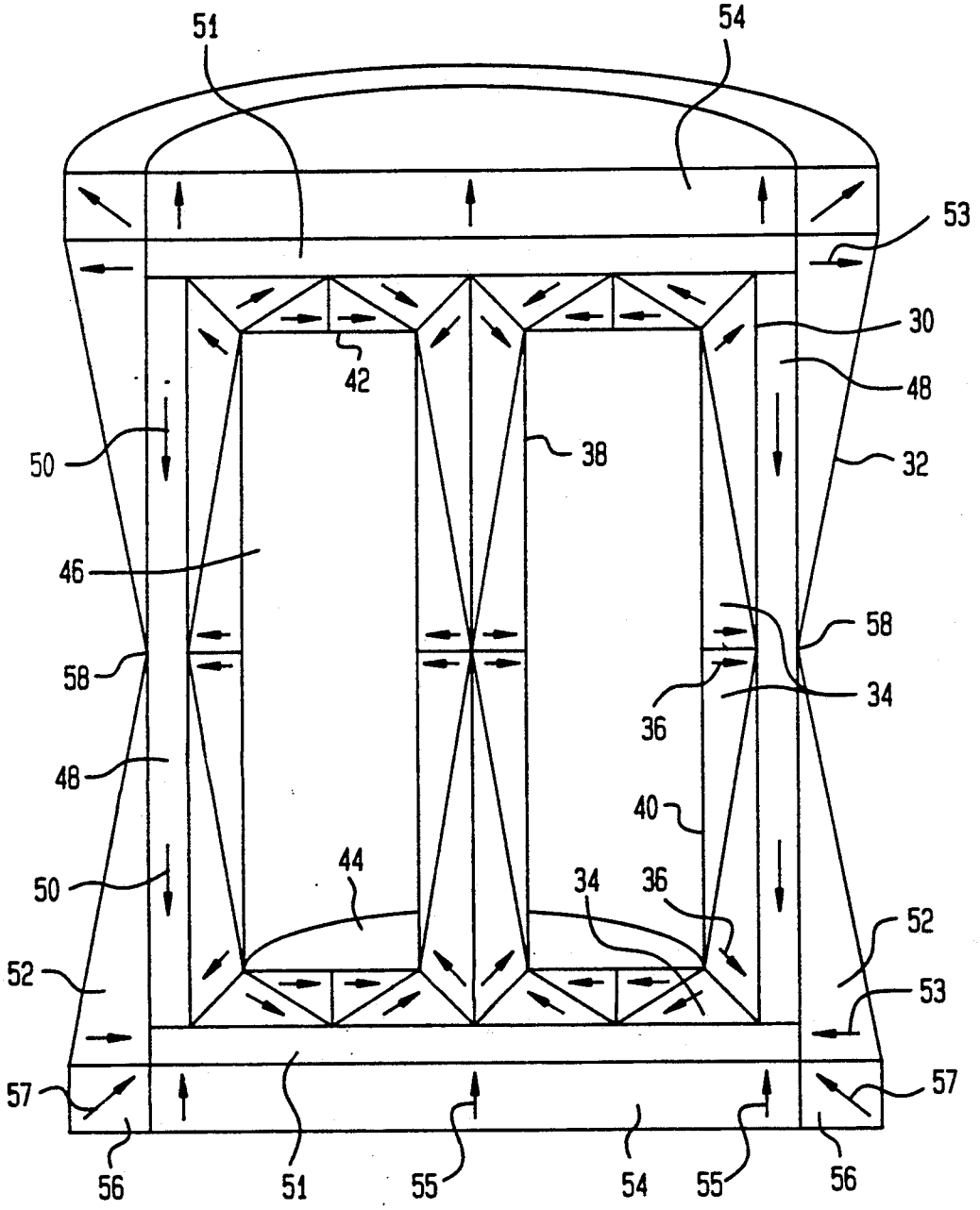

FIG. 2 illustrates another embodiment of the present invention wherein a hollow radial field source 30 is nested within a hollow axial field source 32. The radial field source 30 comprises a plurality of magnetized segments 34 fabricated of MR material, being substantially circular and having a substantially triangular cross-section. Arrows 36 denote the magnetic orientation of the magnetized segments which provide a resultant magnetic field in the radial direction. The magnetized segments are arranged to construct inner and outer concentric cylinders 38 and 40 respectively, and closures 42 and 44 on both ends thereof forming an annular enclosed cavity 46 therein. A full description of this structure can be found in "Enhanced Magnetic Field Within Enclosed Annular Cavity" to Herbert A. Leupold et al, which is concurrently being filed herewith and is incorporated herein by reference.

The axial field source 32 comprises a longitudinally extending magnet 48, fabricated of MR material, which generates the magnetic field. Arrows 50 denote the magnet orientation in the direction parallel to the longitudinal axis of the magnet 48. Iron pole pieces or "irises" 51 are disposed adjacent to each end of magnet 48. The irises ensure that the surface of the disc bounding the end of the cavity is a magnetic equipotential surface A cladding magnet 52 surrounds magnet 32 and is oriented magnetically in the radial direction (arrows 53 acting to reduce magnetic flux leakage, eliminating the exterior effects of the magnetic structure on the surrounding environment and intensifying the magnetic field within the cavity. It has a constant magnetic potential on its outer exterior surface equal to the magnetic potential on the outer surface of the longitudinally extending magnet at a circumferential portion 58 between the ends thereof. Cylindrical end magnets 54 are adjacent each iris and ring-shaped corner magnets 56 are adjacent each end magnet and cladding magnet. The magnetic orientations of these magnets are denoted by arrows 55 and 57 respectively. U.S. Pat. No. 4,647,887 to Herbert A. Leupold entitled "Lightweight Cladding For Magnetic Circuits" more fully defines the axial field source structure and is incorporated by reference herein.

As discussed supra regarding FIG. 1, the inner field source (in this case, the radial field source) is constructed first, and the outer structure (axial field source) is then built around and attached to the inner structure. A conical field is produced from the superposition of the radial field source within the axial field source. The angle with respect to the conical field axis of the conical field is a resultant of the radial field and axial field vectors. The stronger the axial field, the sharper the angle will be to the conical field axis. The stronger the radial field, the larger the angle will be to the conical field axis. The longitudinally extending magnet may also increase in thickness from one end to the other to produce an axial field increasing in magnitude with increasing thickness. Likewise, the cladding magnet must be modified in dimensions to account for the change in flux losses. Adding this vector to the radial field vector will result in a conical field with flux lines of parabolic shape.

Figure 3:
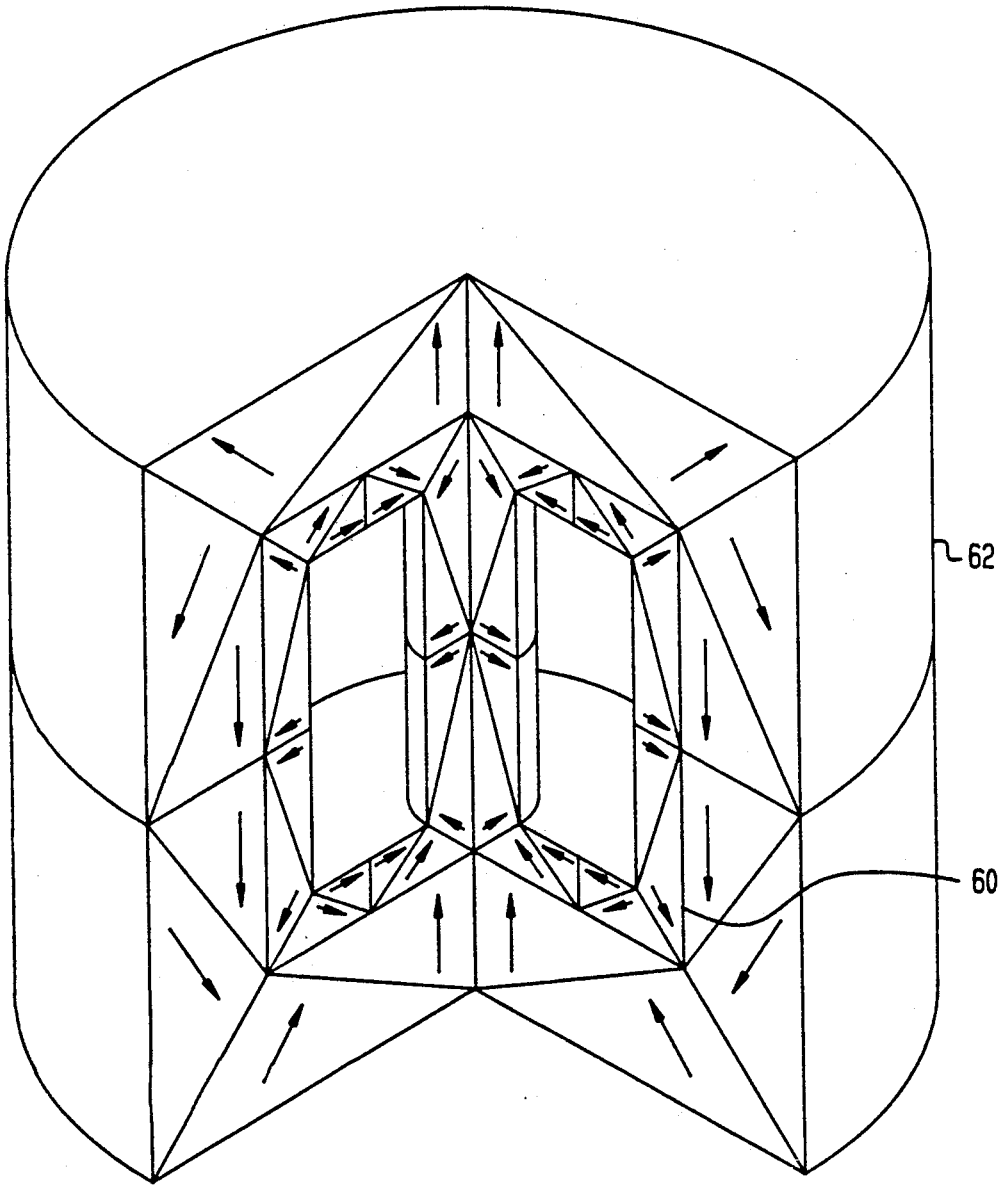

FIG. 3 illustrates yet another combination of radial and axial field sources where the radial field source 60 is nested within the axial field source 62. A conical field is produced by superposing the axial field over the radial field. There appears no need for further discussion of these flux sources since a detailed description has already been provided herein.

In the embodiments of the present invention wherein iron is employed, the source with iron must always be the outer of the two components because iron is not transparent to outer fields (i.e. its magnetic orientation may change from the presence of other existing electric and magnetic fields).

By appropriate functional variation of the radial field with distance from the axis and the axial field with distance from one of the ends, any cylindrically symmetric function of field form can be obtained.

Those skilled in the art will appreciate without any further explanation that within the flux source construction concept of this invention, many modifications and variations are possible to the above disclosed embodiments. Consequently, it should be understood that all such modifications and variations fall within the scope of the following claims.

What is claimed is:

1. A permanent magnet structure comprising:

a radial magnetic field source which comprises a cylinder with a cavity disposed therein, the cylinder being fabricated of magnetically rigid material, having a magnetization perpendicular to an axis of the cavity and being formed by a pair of radially magnetized discs which vary in thickness with distance from a center of the disc and which are fabricated of magnetically rigid material, coaxially aligned parallel to and separated from each other at a given distance, an iron ring cylinder circumscribing and contacting the discs, and cladding magnets which cover each disc and which have a magnetization directed away from the cylinder in a direction parallel to the axis of the cavity; and an axial magnetic field source which comprises a cylinder with a cavity disposed therein, the cylinder being fabricated of magnetically rigid material, having a magnetization parallel to the axis of the cavity, and being formed by a plurality of magnetized segments fabricated of magnetically rigid material, each magnetized segment being substantially circular and having a triangular cross-section, the magnetized segments being arranged to construct a hollow cylinder and closures on both ends thereof, forming the cavity therein and having a magnetic field parallel to the axis of the cavity;

the axial magnetic field source being nested within the radial magnetic field source thereby producing a conical magnetic field in the cavity of the axial magnetic field source.

2. A permanent magnet structure comprising:

a radial magnetic field source which comprises a cylinder with a cavity disposed therein, the cylinder being fabricated of magnetically rigid material and having a magnetization perpendicular to an axis of the cavity; and an axial magnetic field source which comprises a cylinder with a cavity disposed therein, the cylinder being fabricated of magnetically rigid material and having a magnetization parallel to the axis of the cavity;

the radial magnetic field source being nested within the axial magnetic field source thereby producing a conical magnetic field in the cavity of the axial magnetic field source.

3. A permanent magnet structure as defined in claim 2 wherein said radial magnetic field source comprises a plurality of magnetized segments fabricated of magnetically rigid material, each said magnetized segment being substantially circular and having a triangular cross-section, said magnetized segments arranged to construct inner and outer concentric cylinders and closures extending between the ends of said cylinders forming an annular enclosed cavity therein and having a magnetic field perpendicular to the axis of said cylinders.

4. A permanent magnet structure as defined in claim 3 wherein said axial magnetic field source comprises a plurality of magnetized segments fabricated of magnetically rigid material, each said magnetized segment being substantially circular and having a triangular cross-section, said magnetized segments arranged to construct a hollow cylinder and closures on both ends thereof, forming a cylindrical enclosed cavity therein and having a magnetic field parallel to the axis of said cavity.

5. A permanent magnet structure as defined in claim 4 wherein said axial magnetic field source comprises a longitudinally extending first magnet fabricated of magnetically rigid magnet material having a magnetization parallel to the longitudinal axis of said first magnet; a second magnet surrounding a substantial portion of the length of said first magnet, and having a generally radial magnetization transverse to the longitudinal magnetization of said first magnet; said second magnet having a constant magnetic potential on its outer exterior surface equal to the magnetic potential on the outer surface of said first magnet at a circumferential portion between the ends thereof.

6. A permanent magnet structure as defined in claim 5 further comprising an iris of soft magnetic material disposed adjacent each end of said first magnet.

7. A permanent magnet structure as defined in claim 6 further comprising an axially magnetized cylindrical end magnet adjacent each said iris, and a ring-shaped corner magnet adjacent each end magnet and each said cladding magnet.

8. A permanent magnet structure as defined in claim 7 wherein said longitudinally extending first magnet increases in thickness with distance from one end to the other end of said first magnet.

* * * * *